US007481387B2

(12) United States Patent
Lee et al.

(10) Patent No.: US 7,481,387 B2
(45) Date of Patent: Jan. 27, 2009

(54) ICE-CRUSHING DEVICE FOR REFRIGERATORS

(75) Inventors: Wook-yong Lee, Kwangmyeong-si (KR); Seong-jae Kim, Ansan-si (KR)

(73) Assignee: LG Electronics Inc., Seoul (KR)

( * ) Notice: Subject to any disclaimer, the term of this patent is extended or adjusted under 35 U.S.C. 154(b) by 389 days.

(21) Appl. No.: 11/126,356

(22) Filed: May 11, 2005

(65) Prior Publication Data

US 2006/0144976 A1 Jul. 6, 2006

(30) Foreign Application Priority Data

Jan. 6, 2005 (KR) ..... 10-2005-0001332

(51) Int. Cl.
*B02B 1/08* (2006.01)
*F25C 5/02* (2006.01)

(52) U.S. Cl. ..... 241/65; 241/DIG. 17; 62/320

(58) Field of Classification Search ..... 241/65, 241/101.2, DIG. 17; 62/157, 344, 320
See application file for complete search history.

(56) References Cited

U.S. PATENT DOCUMENTS 3,843,067 A * 10/1974 Prada ..... 241/190
6,109,476 A 8/2000 Thompson et al.
2004/0261442 A1 12/2004 Chung et al.

* cited by examiner

*Primary Examiner*—Faye Francis
(74) *Attorney, Agent, or Firm*—Greenblum & Bernstein, P.L.C.

(57) ABSTRACT

Disclosed herein is an ice-crushing device for refrigerators that is capable of crushing ice by torque of rotary blades relative to stationary blades wherein the stationary blades are selectively operated according to selected ice mode, i.e., crushed ice mode or ice cube mode, to allow the stationary blades to have a damper function, thereby preventing stoppage of crushed ice, and therefore, eliminating a locking phenomenon, which is caused by the stoppage of crushed ice. The ice-crushing device comprises an actuating unit for rotating the stationary blades clockwise or counterclockwise about a rotary shaft when a driving force is transmitted to the actuating unit, and a driving unit for supplying the driving force to the actuating unit.

17 Claims, 15 Drawing Sheets

ICE-CRUSHING DEVICE FOR REFRIGERATORS

BACKGROUND OF THE INVENTION

1. Field of the Invention

The present invention relates to an ice-crushing device for refrigerators that is capable of crushing ice by torque of rotary blades relative to stationary blades, and, more particularly, to an ice-crushing device for refrigerators that is capable of selectively operating the stationary blades according to selected ice mode, i.e., crushed ice mode or ice cube mode, to allow the stationary blades to have a damper function, thereby preventing stoppage of crushed ice, and therefore, eliminating a locking phenomenon, which is caused by the stoppage of crushed ice.

2. Description of the Related Art

Generally, a refrigerator is an apparatus that stores foods in a refrigerated state and/or a frozen state according to the principle of a refrigerating cycle to consecutively perform compressing, condensing, expanding and evaporating processes to change the state of refrigerant. Recently, large-capacity complex refrigerators having other various functions in addition to simple refrigerating and freezing functions have been increasingly used.

The most typical additional function of each of the large-capacity complex refrigerators is a dispenser function to allow for a user to easily and conveniently take water and ice out of the refrigerator without opening door(s) of the refrigerator by pushing a button provided at the refrigerator. The large-capacity complex refrigerators each having such a dispenser function may be classified into a side-by-side type refrigerator comprising a freezing chamber and a chilling chamber, which are arranged in the lateral direction of the refrigerator while a partition is disposed between the freezing chamber and the chilling chamber, and a bottom-freezer type refrigerator comprising a side-by-side type chilling chamber and a freezing chamber disposed under the side-by-side type chilling chamber.

FIG. 1 is a perspective view showing a general side-by-side type refrigerator.

As shown in FIG. 1, the side-by-side type refrigerator comprises: a water supplying unit 1 for supplying water introduced into the refrigerator from the outside into freezing and chilling chambers of the refrigerator; a water tank 2 for storing water supplied from the water supplying unit 1; a water supplying pipe 3 for transferring water supplied from the water tank 2 to the freezing chamber; an icemaker assembly 4 for receiving water transferred through the water supplying pipe 3 to make ice; another water supplying pipe 6 for transferring water supplied from the water tank 2 to the chilling chamber; and a dispenser 7 for selectively dispensing water transferred through the water supplying pipe 6 and ice supplied from the icemaker assembly 4.

The icemaker assembly 4 comprises an automatic icemaker 4*a* and an ice bank 5. As shown in FIG. 2, the ice bank 5 incorporates a coil spring-shaped auger 53, which is rotated when a rotating force of a motor 52 is transmitted to the auger 53, and a cylindrical helix part 54, which has a screw formed on the outer circumferential surface thereof. Ice dropping from the automatic icemaker is transferred to a crusher part 55 by the auger 53 and the helix part 54. The crusher part 55 comprises rotary blades 55*a* rotatable about the same axis as the auger 53 and stationary blades 55*b*. Ice transferred to the crusher part 55 is crushed by the rotary blades 55*a* and the stationary blades 55*b*.

An ice-making chamber, which incorporates the icemaker assembly therein, may be disposed at the inside of a freezing chamber door so as to increase the inner space of the freezing chamber. The ice-making chamber disposed at the inside of the freezing chamber door is referred to as an "indoor ice-making chamber." The ice bank, which is applied to the indoor ice-making chamber, has a flap part 56 instead of the cylindrical helix part 54, as shown in FIG. 3. The flap part 56 performs a constant-speed ice-discharging operation, which is performed by the cylindrical helix part 54 in the icemaker assembly 4 as shown in FIG. 2. The indoor ice-making chamber may also be applied to the bottom-freezer type refrigerator.

Under the flap part 56 is disposed a damper 58 for performing a rotating operation about a hinge shaft 58*a* by a solenoid (not shown) according to selected ice mode, i.e., ice cube mode or crushed ice mode, to open or close a discharging port 57 of the ice bank 5. When the discharging port 57 of the ice bank 5 is opened, i.e., the discharging port 57 of the ice bank 5 is not closed by the damper 58, ice cubes, i.e., uncrushed ice, are discharged through the discharging port 57 of the ice bank 5. When the discharging port 57 of the ice bank 5 is closed by the damper 58, on the other hand, ice cubes are crushed by torque of the rotary blades 55*a* relative to the stationary blades 55*b*, and thereby, crushed ice is dispensed through the dispenser 7.

In the above-mentioned conventional ice-crushing system, however, the damper is disposed horizontally while the stationary blades are disposed vertically, and therefore, crushed ice may be stopped between the damper and the stationary blades when the discharging port of the ice bank is closed by the damper. As a result, the crushed ice is not discharged. In other words, a locking phenomenon occurs.

Especially when the crushed ice is maintained in the stopped state for a long period of time; the crushed ice may be fixedly attached to the damper. Consequently, no operation is properly performed even though an ice cube mode switching signal is transmitted to the solenoid of the damper.

SUMMARY OF THE INVENTION

Therefore, the present invention has been made in view of the above problems, and it is an object of the present invention to provide an ice-crushing device for refrigerators that is capable of crushing ice by torque of rotary blades relative to stationary blades wherein the stationary blades are selectively operated according to selected ice mode, i.e., crushed ice mode or ice cube mode, to allow the stationary blades to have a damper function, thereby preventing stoppage of crushed ice, and therefore, eliminating a locking phenomenon, which is caused by the stoppage of crushed ice.

In accordance with the present invention, the above and other objects can be accomplished by the provision of an ice-crushing device for refrigerators that is capable of crushing ice by torque of rotary blades, which are fitted on the shaft of a motor for a performing a rotating operation, relative to stationary blades, wherein the ice-crushing device comprises: an actuating unit for rotating the stationary blades clockwise or counterclockwise about a rotary shaft when a driving force is transmitted to the actuating unit; and a driving unit for supplying the driving force to the actuating unit.

Preferably, the actuating unit comprises: guide slits each formed at one side of each of the stationary blades; an actuating lever having one end inserted in the guide slits, the actuating lever being rotated about the other end, when the driving force of a driving unit is transmitted to the actuating lever, to perform a rectilinear reciprocating movement along the guide slits; and first and second stoppers for restricting rotation of the actuating lever, respectively.

Preferably, the angle between a first reference line, which is a line passing through the center of the actuating lever, and a second reference line, which is a line passing from the end of the actuating lever through the center of the rotary shaft of the stationary blades, is an acute angle.

Preferably, the driving unit comprises: a driving lever integrally formed with the other end of a central rotating shaft, which longitudinally extends along the rotation center of the actuating lever, the driving lever being formed in the shape of a crank such that the driving lever is symmetrical to the actuating lever about the middle of the central rotating shaft; and a solenoid linked with the driving lever, the solenoid having a rod, which is vertically reciprocated, when the solenoid is turned on/off, to rotate the driving lever about the central rotating shaft.

Preferably, the solenoid is provided at the lower end of the rod thereof with a hook, which is opened at the front and rear parts thereof and has an actuating space part, the driving lever being inserted through the actuating space part of the hook, and the actuating lever has a restoring spring mounted thereon for returning the actuating lever to its original position when the solenoid is turned off.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
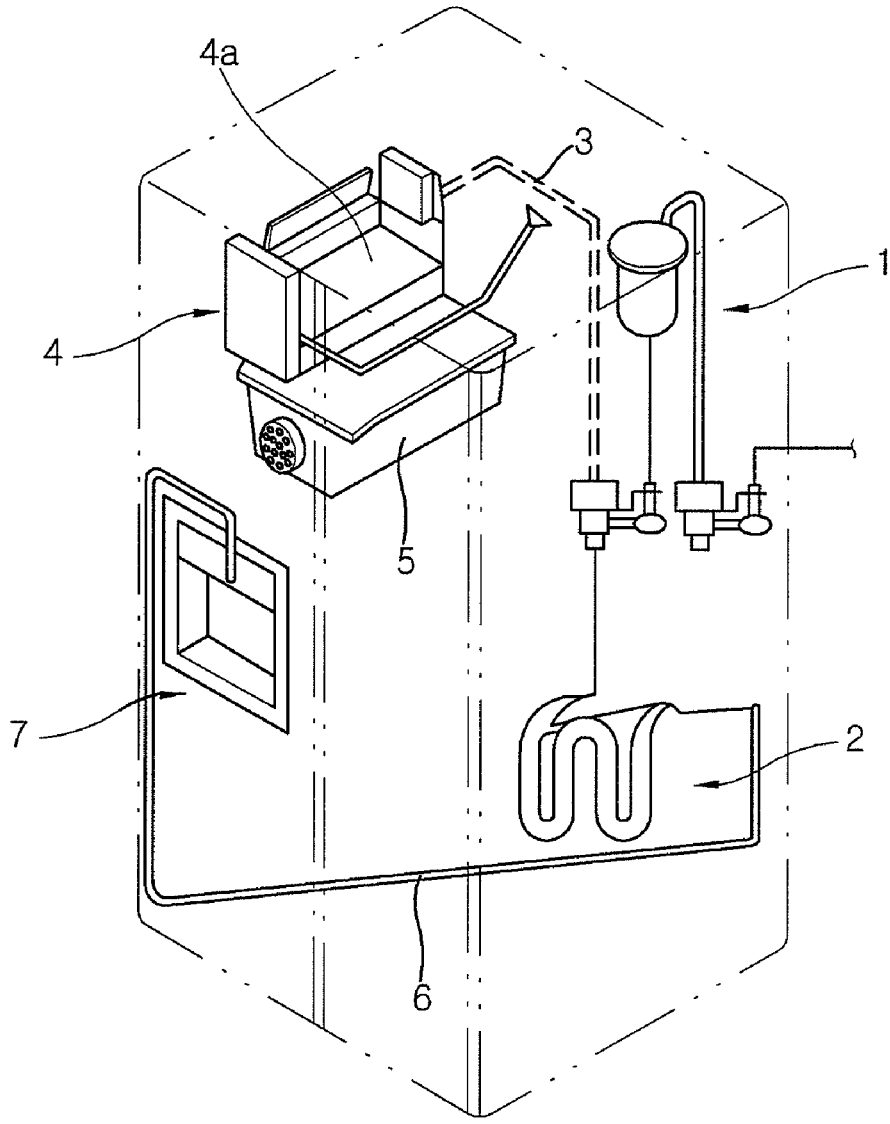
FIG.1 PRIOR ART
FIG. 1 is a perspective view showing a general side-by-side type refrigerator.
Figure 2:
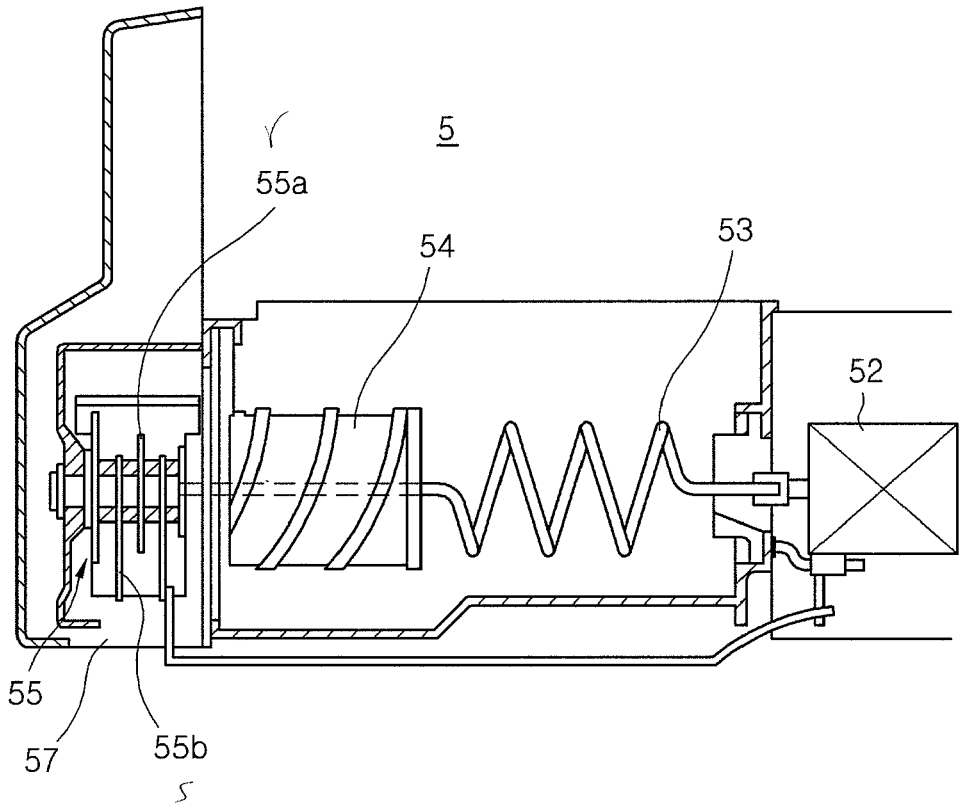
FIG.2 PRIOR ART
FIG. 2 is an enlarged sectional view of an ice bank of the side-by-side type refrigerator shown in FIG. 1.
Figure 3:
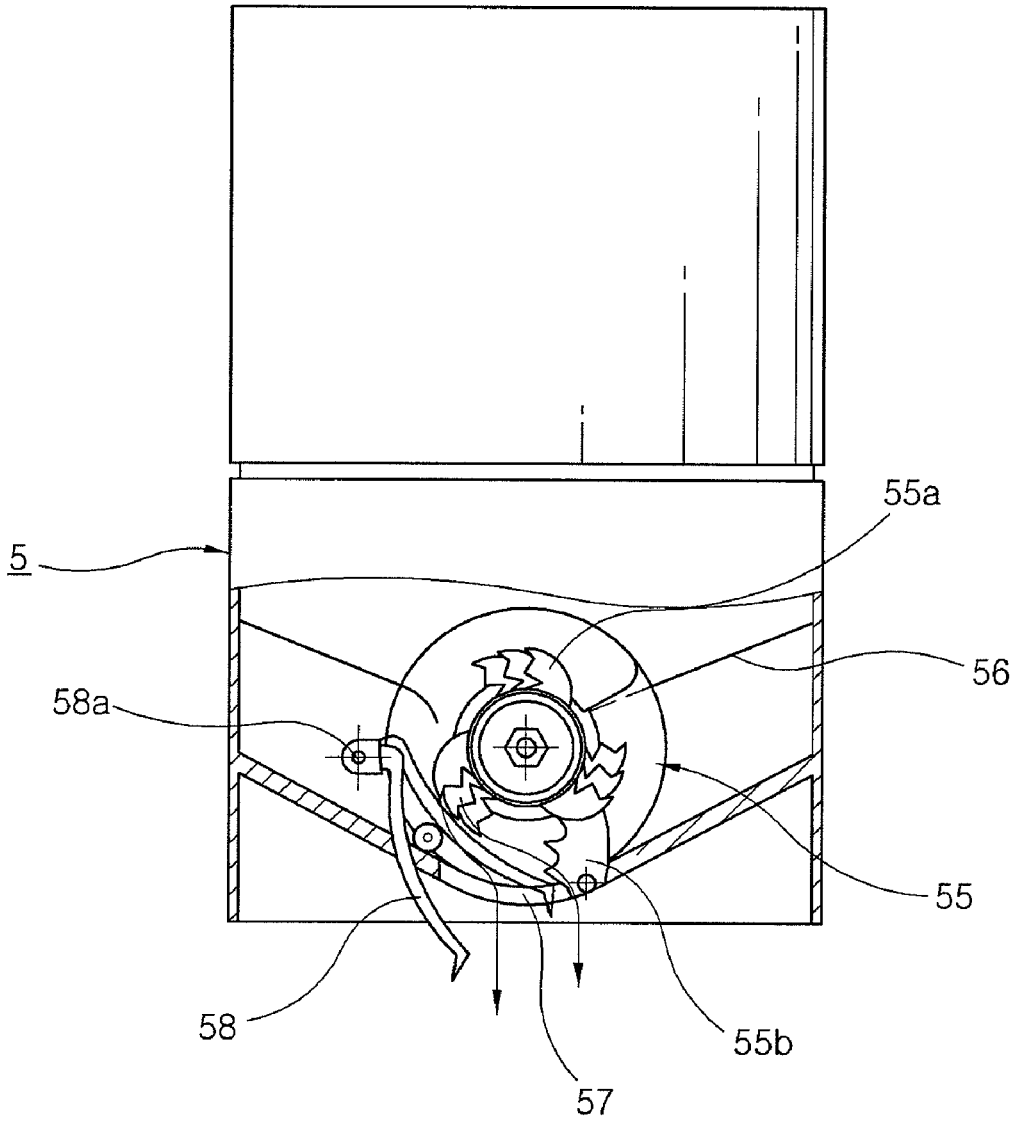
FIG.3 PRIOR ART
FIG. 3 is a side view showing a conventional crushing unit of the ice bank, which is mounted in an indoor ice-making chamber of the side-by-side type refrigerator.
Figure 4:
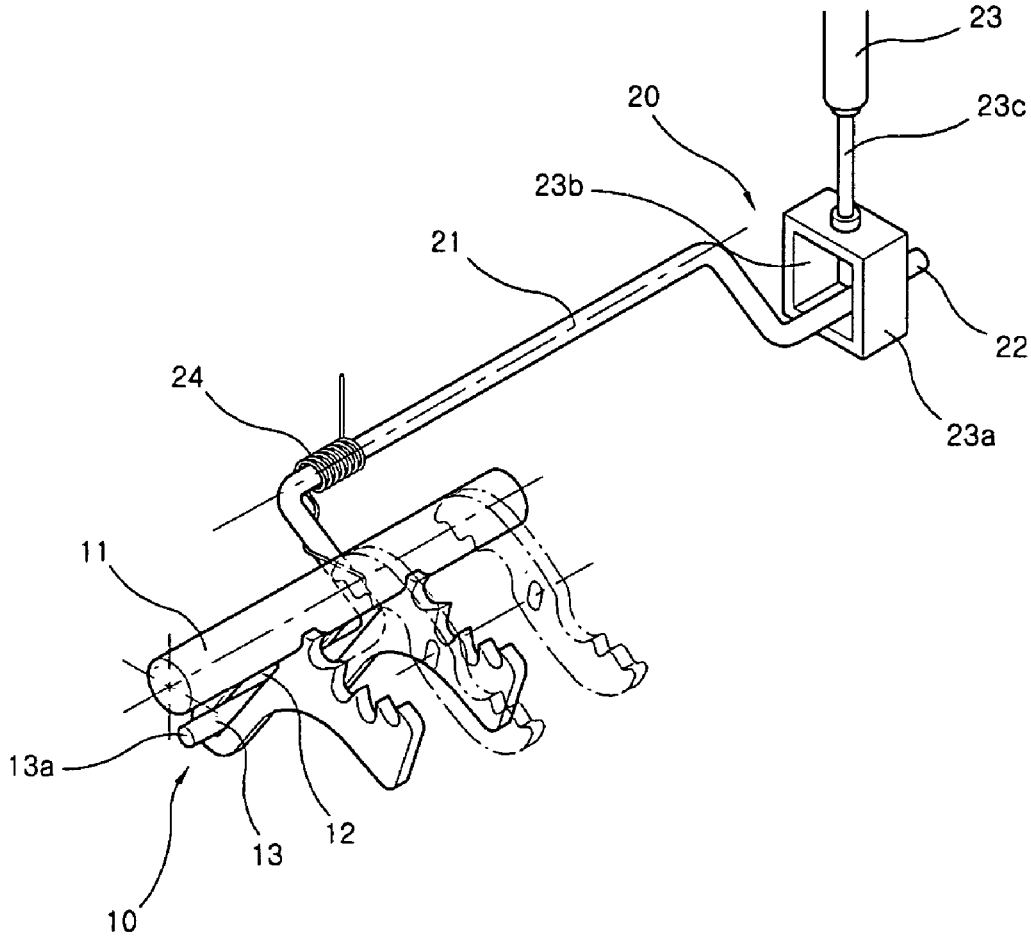
FIG. 4 is a perspective view showing an ice-crushing device for refrigerators according to a first preferred embodiment of the present invention.
Figure 5:
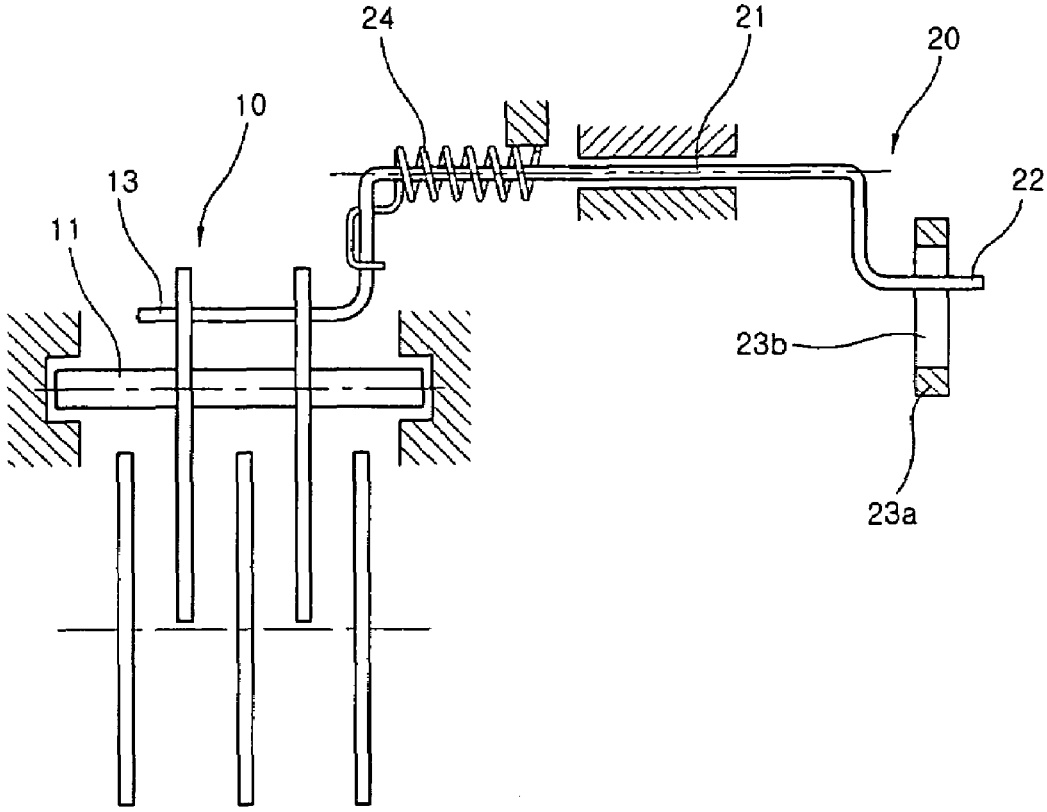
FIG. 5 is a plan view of the ice-crushing device for refrigerators shown in FIG. 4.

FIG. 4 is a perspective view showing an ice-crushing device for refrigerators according to a first preferred embodiment of the present invention, and FIG. 5 is a plan view of the ice-crushing device for refrigerators shown in FIG. 4.

As shown in FIGS. 4 and 5, the ice-crushing device comprises a first set of blades, referred to here as stationary blades 55*b*, which are rotatable about a rotary shaft 11. The rotation of the stationary blades 55*b* about the rotary shaft 11 is performed by an actuating unit 10. When a driving force of a driving unit is transmitted to the actuating unit 10, the actuating unit 10 rotates the stationary blades 55*b* clockwise or counterclockwise about the rotary shaft 11 to have a damper function when the ice mode is switched between crushed ice mode and ice cube mode.

The actuating unit 10 comprises: a guide slit 12 formed at one side of each of the stationary blades 55*b*; and an actuating lever 13 inserted in the guide slits 12 for performing a rotating operation clockwise or counterclockwise when the driving force of the driving unit 20 is transmitted to the actuating lever 13. The actuating lever 13 extends from one end of a central rotating shaft 21 constituting the driving unit 20 while being bent in the shape of a crank. Above and under the actuating lever 13 are disposed first and second stoppers 14 and 14*a* for restricting rotation of the actuating lever 13, respectively (see FIGS. 6*a* and 6*b*).

The driving unit 20 comprises a driving lever 22 integrally formed with the other end of the central rotating shaft 21, which longitudinally extends along the rotation center of the actuating lever 13 as described above. The driving lever 22 is bent in the shape of a crank such that the driving lever 22 is symmetrical to the actuating lever 13 about the middle of the central rotating shaft 21. The driving lever 22 is linked with a solenoid 23, which is vertically disposed, such that the driving lever 22 is rotated clockwise or counterclockwise about the central rotating shaft 21 as the solenoid 23 is operated.

For the linkage between the driving lever 22 and the solenoid 23, the solenoid 23 is provided at the lower end of a rod 23*c* thereof with a hook 23*a*, which is opened at the front and rear parts thereof and has an actuating space part 23*b*, and the driving lever 22 is inserted through the actuating space part 23*b* of the hook 23*a*. In this way, the driving lever 22 is linked with the solenoid 23. On the actuating lever 13 is mounted a restoring spring 24 for returning the driving lever 22 as well as the actuating lever 13 to the respective original positions when the solenoid 23 is turned off. Preferably, the restoring spring 24 is a common torsion spring.

It should be noted, however, that the driving unit 20 is not limited to the above-described construction as far as the driving unit 20 is rotated clockwise or counterclockwise about the central rotating shaft 21. Preferably, the stationary blades 55*b* are disposed on the rotary shaft 11 in parallel with each other while being spaced apart from each other. The rotary blades 55*a* pass between the stationary blades 55*b* to crush ice.

The operation of the ice-crushing device for refrigerators with the above-stated construction according to the first preferred embodiment of the present invention will be described hereinafter with reference to FIGS. 6*a* and 6*b*.

Figure 6A:
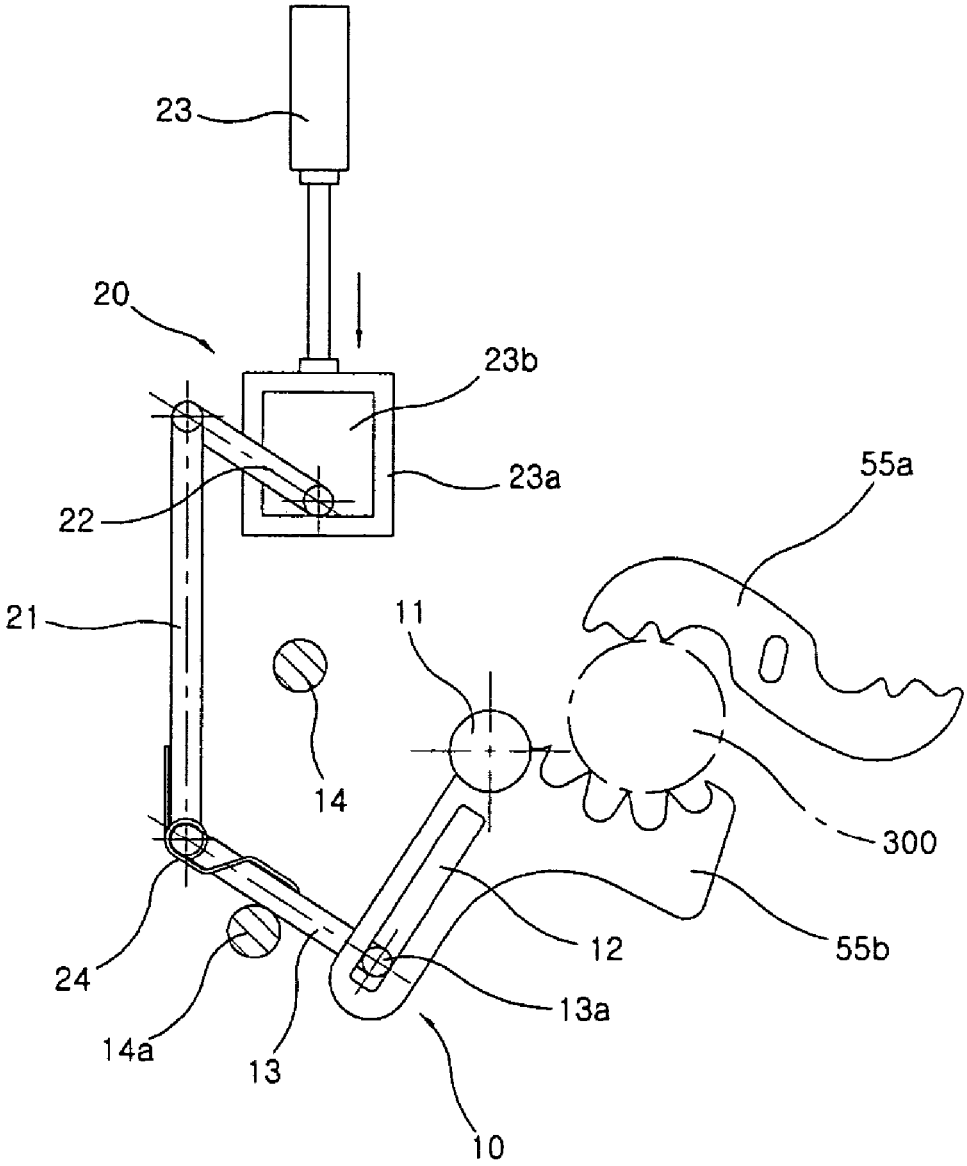
FIG. 6*a* is a view showing the operation of the ice-crushing device for refrigerators shown in FIG. 4 in crushed ice mode.

FIG. 6*a* is a view showing the operation of the ice-crushing device for refrigerators shown in FIG. 4 in crushed ice mode.

In the crushed ice mode, the solenoid 23 is turned off, and therefore, the driving lever 22 and the actuating lever 13 are rotated clockwise about the central rotating shaft 21. As a result, the actuating lever 13 is rectilinearly moved along the guide slits 12 of the respective stationary blades 55*b*. Consequently, the stationary blades 55*b* are rotated counterclockwise about the rotary shaft 11 from the state shown in FIG. 6*b* to the state shown in FIG. 6*a*.

At this time, the rotation of the stationary blades 55*b* is restricted by the second stopper 14*a*. Also, the second stopper 14*a* serves to react against the torque transmitted to the stationary blades 55*b* clockwise via ice 300 by the rotary blades 55*a* rotating counterclockwise.

Figure 6B:
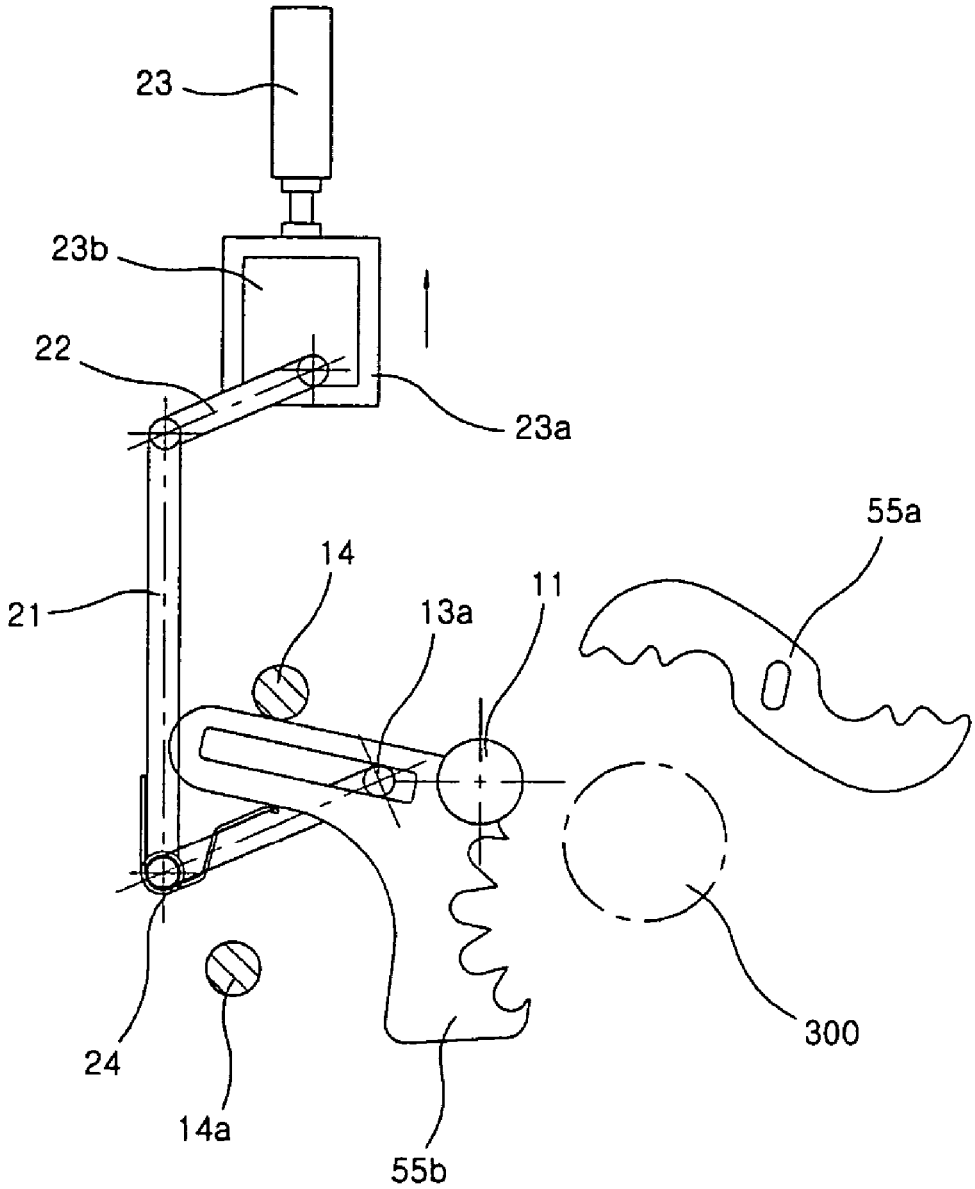
FIG. 6*b* is a view showing the operation of the ice-crushing device for refrigerators shown in FIG. 4 in ice cube mode.

FIG. 6*b* is a view showing the operation of the ice-crushing device for refrigerators shown in FIG. 4 in ice cube mode.

In the ice cube mode, the solenoid 23 is turned on, and therefore, the hook 23*a* of the solenoid 23 is moved upward. As a result, the driving lever 22 is rotated counterclockwise about the central rotary shaft 21 against the elastic force of the restoring spring 24. As the driving lever 22 is rotated counterclockwise about the central rotary shaft 21, the actuating lever 13 is also rotated counterclockwise about the central rotary shaft 21.

As a result, the actuating lever 13 is rectilinearly moved along the guide slits 12 of the respective stationary blades 55*b*. Consequently, the stationary blades 55*b* are rotated clockwise about the rotary shaft 11 from the state shown in FIG. 6*a* to the state shown in FIG. 6*b*, with the result that the distances between the stationary blades 55*b* and the second set of blades, referred to here as the rotary blades 55*a*, are increased, and therefore, ice is discharged while not being crushed, i.e., as ice cubes.

When the solenoid 23 is turned off, the hook 23*a* of the solenoid 23 is returned to its original position. As a result, the actuating lever 13, which has been rotated counterclockwise as shown in FIG. 6*b*, is returned to the state of the crushed ice mode as shown in FIG. 6*a* by the restoring force of the restoring spring 24.

It is required that the angle between the actuating lever 13 and each of the stationary blades 55*b* be an acute angle in the crushed ice mode as shown in FIG. 6*a*. If the angle between the actuating lever 13 and each of the stationary blades 55*b* is an obtuse angle in the crushed ice mode as shown in FIG. 6*a*, the second stopper 14*a* does not serve to react against the torque transmitted to the stationary blades 55*b* via ice by rotation of the rotary blades 55*a*, which will be described below in more detail with reference to FIGS. 7*a* and 7*b*.

Figure 7A:
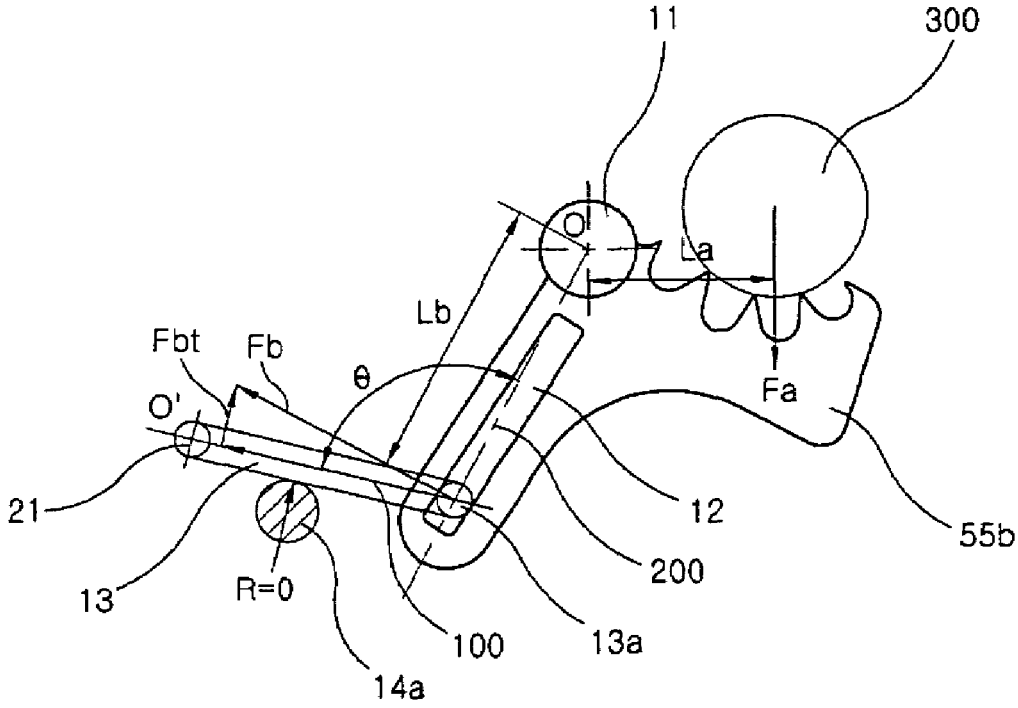
FIG. 7*a* is a view showing the ice-crushing device for refrigerators shown in FIG. 4 arranged at an obtuse angle.
Figure 7B:
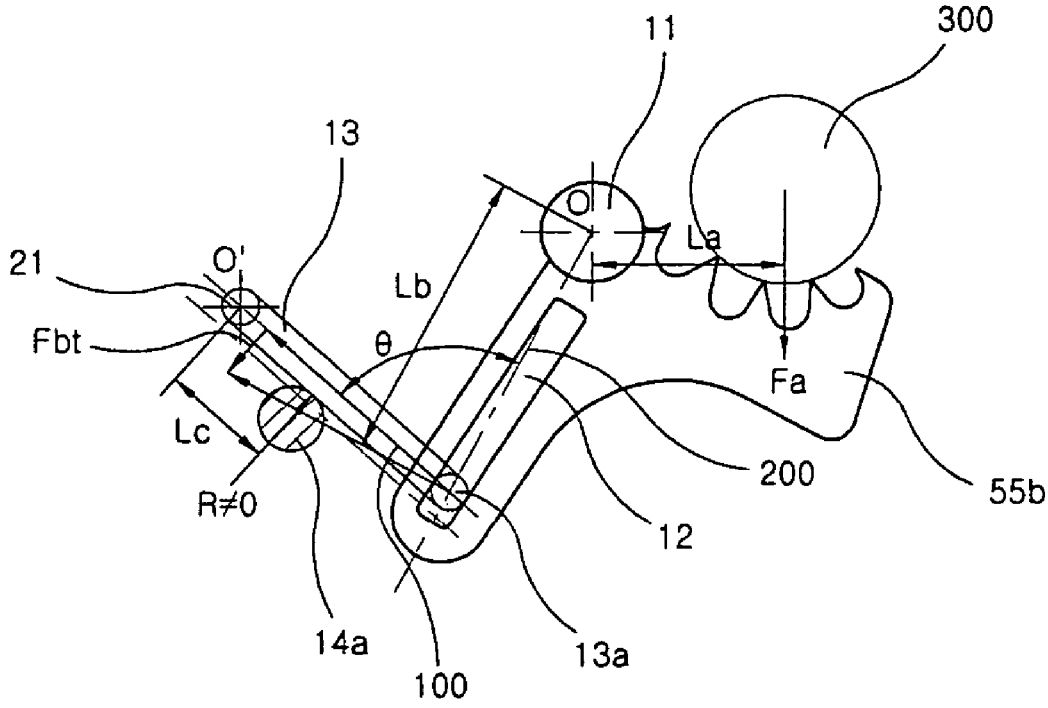
FIG. 7*b* is a view showing the ice-crushing device for refrigerators shown in FIG. 4 arranged at an acute angle.

FIG. 7*a* is a view showing the obtuse angle between the actuating lever and the respective stationary blade. The line passing through the center of the actuating lever 13 is referred to as a first reference line 100, and the line passing from the end 13*a* of the actuating lever 13*a* through the center of the rotary shaft 11 of the stationary blades 55*b* is referred to as a second reference line 200.

When the angle θ between the first reference line 100 and the second reference line 200 is an obtuse angle, there is no force to react against Fbt (>0 in the direction of t) as shown in FIG. 7*a*. As a result, the actuating lever 13 is rotated clockwise by the clockwise torque of the rotary blades 55*a*, which is transmitted to the stationary blades 55*b* via ice. Consequently, the ice-crushing device is operated not in the crushed ice mode but in the ice cube mode, and therefore, the ice is not crushed. At this time, the torque To applied to the center O of the rotary shaft 11 of the stationary blades 55*b* is expressed by the following equation: To=Fa×La. The force Fb applied to the end 13*a* of the actuating lever 13 is expressed by the following equation: Fb=To/Lb.

When the angle θ between the first reference line 100 and the second reference line 200 is a right angle, Tbt=0, and therefore, the reaction force R=0. As a result, the actuating lever 13 is not moved, i.e., the actuating lever 13 is in a neutral state. However, this neutral state is very unstable, and therefore, undesirable.

When the angle θ between the first reference line 100 and the second reference line 200 is an acute angle, on the other hand, Fbt is applied in the direction of −t, and therefore, the reaction force R is applied by the second stopper 14*a* (R=Fbt≠0). As a result, clockwise torque To', which is expressed by the following equation: To'=Fbt×Lc, is generated at a lever shaft O'. Consequently, the supporting and restricting operation of the second stopper 14*a* to the stationary blades 55*b* is stably carried out, and therefore, the ice-crushing operation is accurately performed in the crushed ice mode.

Figure 8:
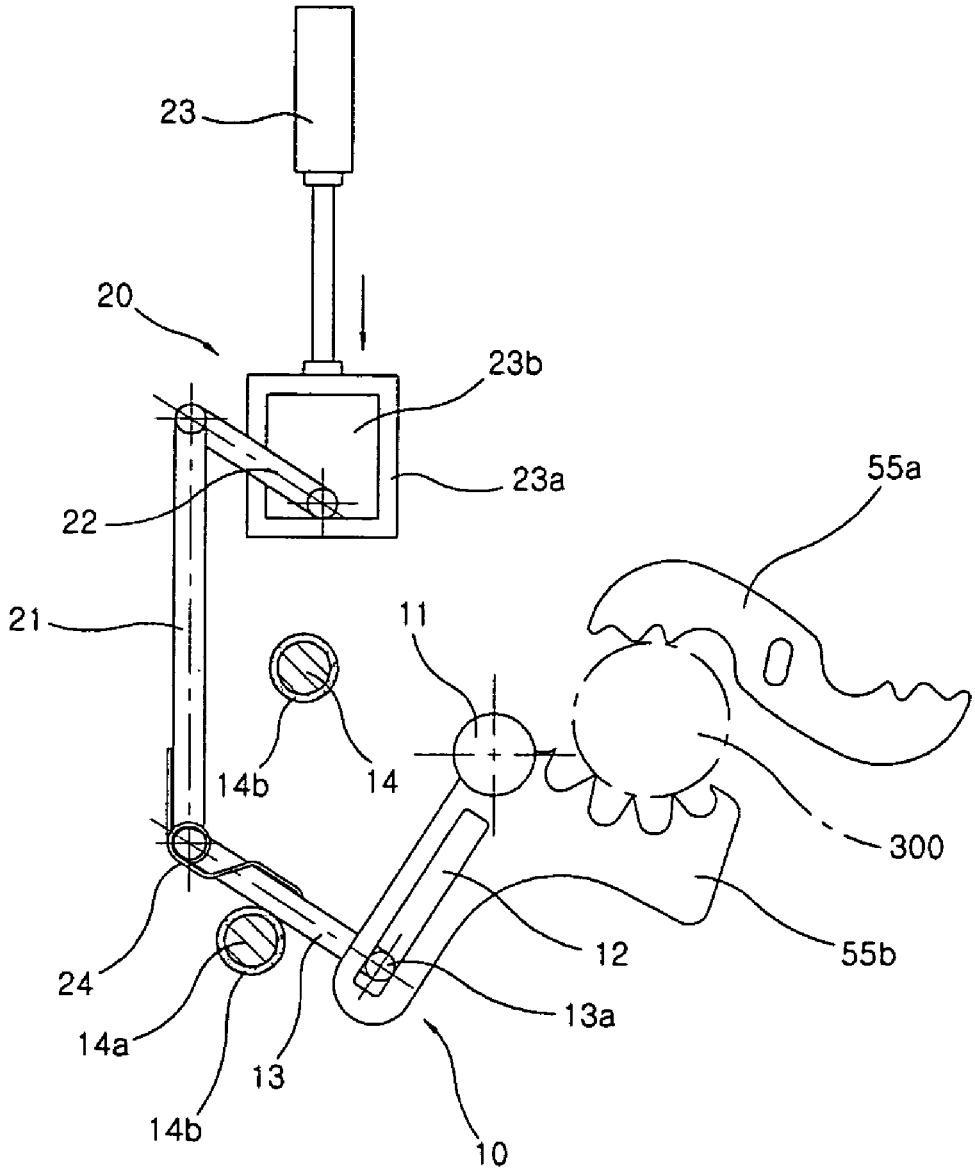
FIG. 8 is a view of the ice-crushing device for refrigerators showing shock-absorbing members respectively disposed on first and second stoppers according to the present invention.

On the outer circumferential surfaces of the first stopper 14 and the second stopper 14*a* are disposed shock-absorbing members 14*b*, respectively, as shown in FIG. 8. Each of the shock-absorbing members 14*b* is composed of a tube made of rubber. Impact and noise generated when the actuating lever 13 collides with the first stopper 14 or the second stopper 14*a* are eliminated by the shock-absorbing members 14*b*.

Figure 9:
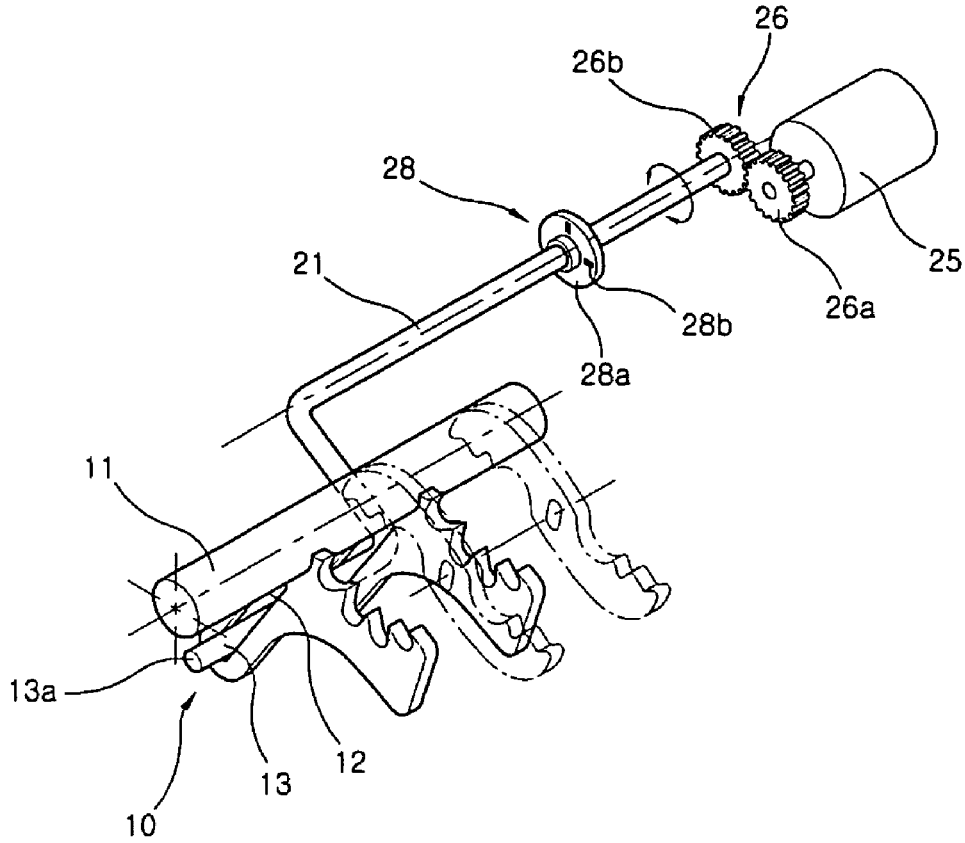
FIG. 9 is a perspective view showing an ice-crushing device for refrigerators according to a second preferred embodiment of the present invention.

FIG. 9 is a perspective view showing an ice-crushing device for refrigerators according to a second preferred embodiment of the present invention.

As shown in FIG. 9, the ice-crushing device for refrigerators according to the second preferred embodiment of the present invention comprises a spur gear set 26, which serves as the driving unit of the ice-crushing device for refrigerators according to the first preferred embodiment of the present invention, connected to a motor 25. To this end, the ice-crushing device for refrigerators according to the second preferred embodiment of the present invention has a central rotating shaft extending along the rotating center of the actuating lever 13.

The spur gear set 26 comprises: a driving spur gear 26*a* fitted on the shaft of the motor 25, the driving spur gear 26*a* having teeth formed in parallel with the shaft of the motor 25 ; and a driven spur gear 26*b* engaged with the driving spur gear 26*a* and fitted on the central rotating shaft 21, the driven spur gear 26*b* having teeth formed in parallel with central rotating shaft 21. The shaft of the motor 25 is in parallel with the central rotating shaft 21.

Figure 10:
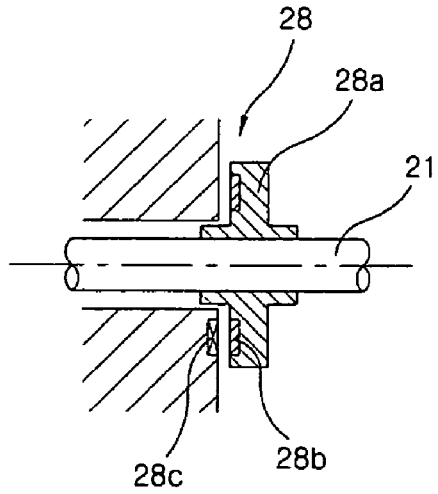
FIG. 10 is an enlarged view, partly in section, of a position sensing unit of the ice-crushing device for refrigerators according to the second preferred embodiment of the present invention shown in FIG. 9.

The rotation of the central rotating shaft 21 is restricted by a position detecting unit 28. As shown in FIG. 10, the position detecting unit 28 comprises: a rotary disk 28*a* fitted on the central rotating shaft 21; a plurality of position detecting pieces 28*b* formed at one side surface of the rotary disk 28*a*; and a detecting sensor 28*c* disposed opposite to the position detecting pieces 28*b*.

In the ice-crushing device for refrigerators according to the second preferred embodiment of the present invention as described above, the driving force of the motor 25 is transmitted to the central rotating shaft 21 through the driving spur gear 26*a* and the driven spur gear 26*b*. As the driving force of the motor 25 is transmitted to the central rotating shaft 21, the central rotating shaft 21 is rotated in one direction, and therefore, the operation of the actuating lever 13 in connection with the stationary blades 55*b* is performed.

As the central rotating shaft 21 is rotated, the rotary disk 28*a* is also rotated. At this time, the position detecting pieces

28*b* of the rotary disk 28*a* are detected by the detecting sensor 28*c*. When the position detecting pieces 28*b* of the rotary disk 28*a* are detected by the detecting sensor 28*c*, the motor 25 is rotated in alternating directions, and therefore, the rotation of the actuating lever 13 is restricted.

Figure 11:
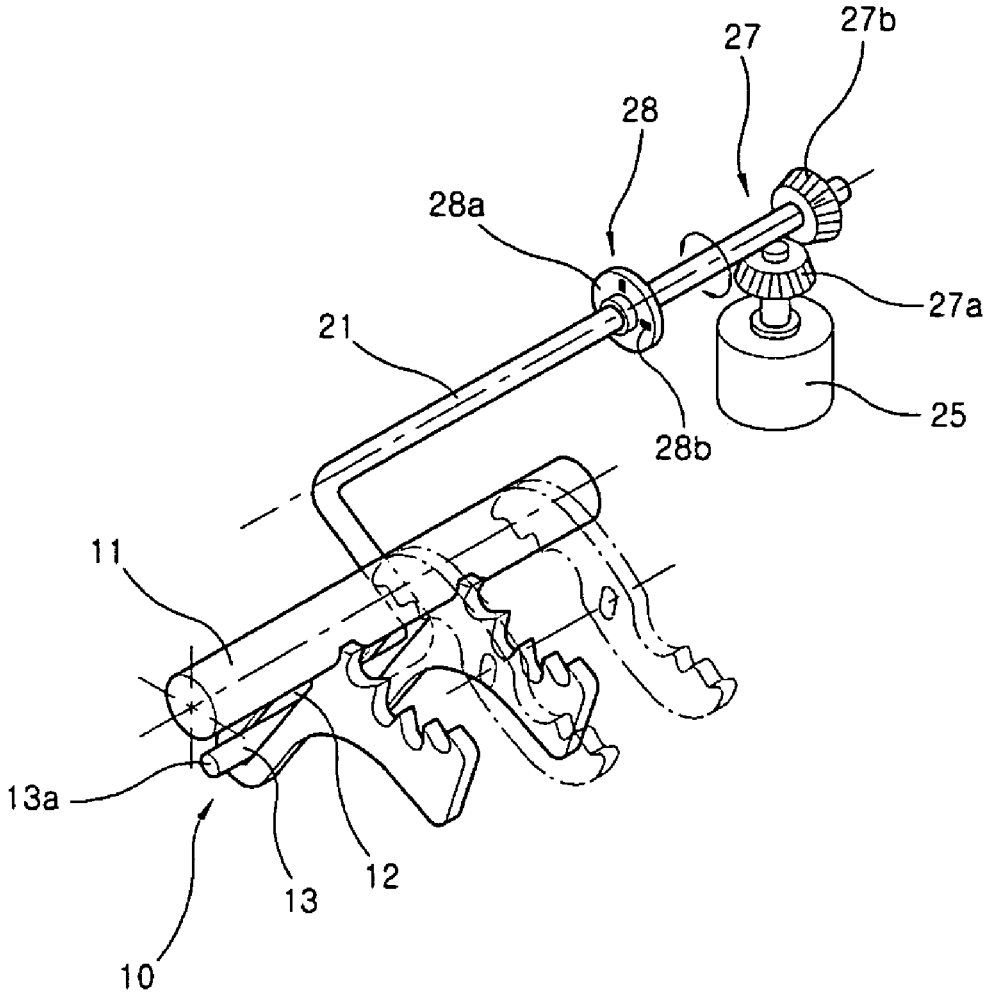
FIG. 11 is a perspective view showing an ice-crushing device for refrigerators according to a third preferred embodiment of the present invention.

FIG. 11 is a perspective view showing an ice-crushing device for refrigerators according to a third preferred embodiment of the present invention.

As shown in FIG. 11, the ice-crushing device for refrigerators according to the third preferred embodiment of the present invention uses a bevel gear set 27, as a driving unit, instead of the spur gear set of the second preferred embodiment of the present invention.

The bevel gear set 27 comprises: a driving bevel gear 27*a* fitted on the shaft of the motor 25, which is vertically disposed, the driving bevel gear 27*a* having teeth formed at the conical surface thereof; and a driven bevel gear 27*b* fitted on the central rotating shaft 21 and engaged with the driving bevel gear 27*a* while the driven bevel gear 27*b* is at a right angle to the driving bevel gear 27*a*, the driven bevel gear 27*b* having teeth formed at the conical surface thereof. The shaft of the motor 25 is at a right angle to the central rotating shaft 21. Consequently, the driving force of the motor 25 is perpendicularly transmitted to the central rotating shaft 21.

The rotation of the central rotating shaft 21 is restricted by the position detecting pieces 28*b* of the rotary disk 28*a* fitted on the central rotating shaft 21 and the detecting sensor 28*c*, as in the second preferred embodiment of the present invention. The bevel gear set and the spur gear set may be properly used while being arranged side by side.

Figure 12:
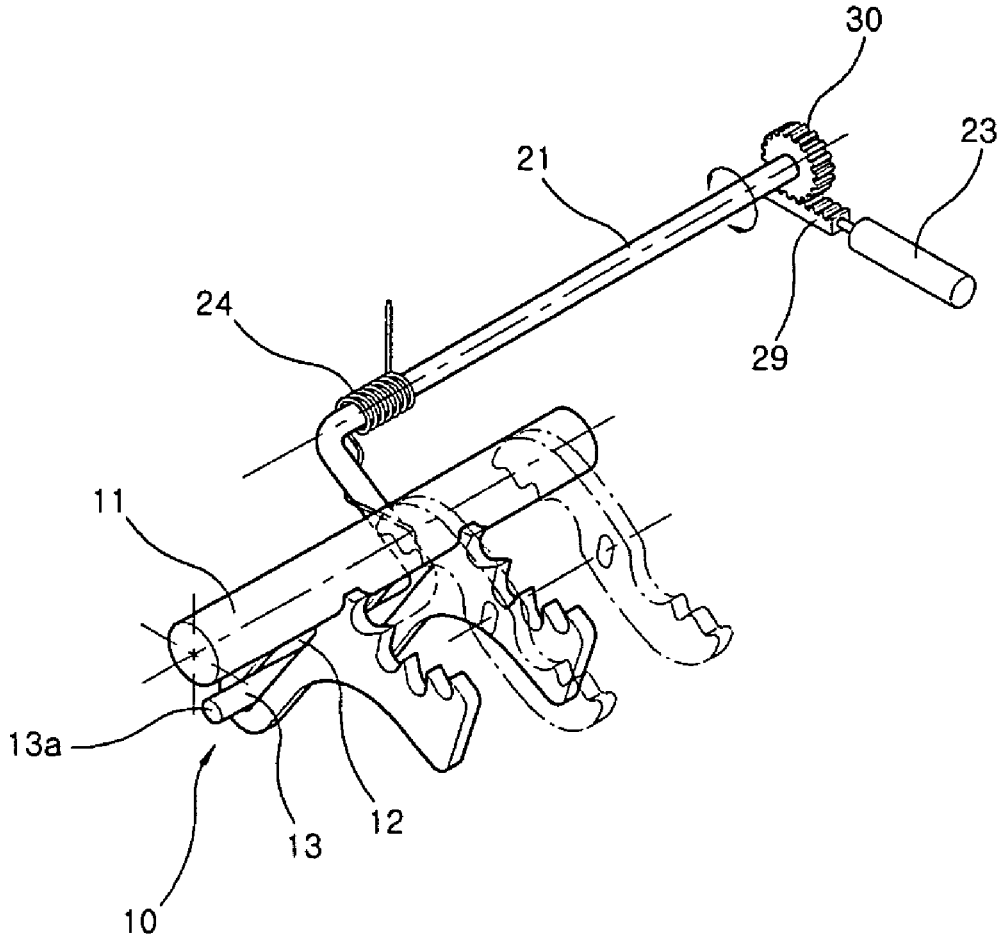
FIG. 12 is a perspective view showing an ice-crushing device for refrigerators according to a fourth preferred embodiment of the present invention.

FIG. 12 is a perspective view showing an ice-crushing device for, refrigerators according to a fourth preferred embodiment of the present invention.

The ice-crushing device for refrigerators according to the fourth preferred embodiment of the present invention uses a rack 29 and a pinion 30, as a driving unit, such that the driving force of the solenoid 23 is accurately transmitted to the central rotating shaft 21 while using the driving force of the solenoid 23 as in the first preferred embodiment of the present invention.

The rack 29 is a linear gear, which extends from the rod of the motor 25 in the longitudinal direction. The rack 29 is engaged with the pinion 30 fitted on the central rotating shaft 21. When the solenoid 23 is turned on, the rack 29 is linearly moved forward, and therefore, the pinion 30 engaged with the rack 29 is rotated. Consequently, the central rotating shaft 21 and the actuating lever 13 are rotated.

On the actuating lever 13 is mounted a restoring spring 24 for returning the actuating lever 13 to its original position when the solenoid 23 is turned off. Preferably, the restoring spring 24 is a common torsion spring.

In the ice-crushing device for refrigerators with the above-stated construction according to the fourth preferred embodiment of the present invention, the rotation of the central rotating shaft 21 is decided based on the movement of the solenoid 23, and therefore, the position detecting unit, which is requisite in the second or third preferred embodiment of the present invention, is not necessary.

Figure 13A:
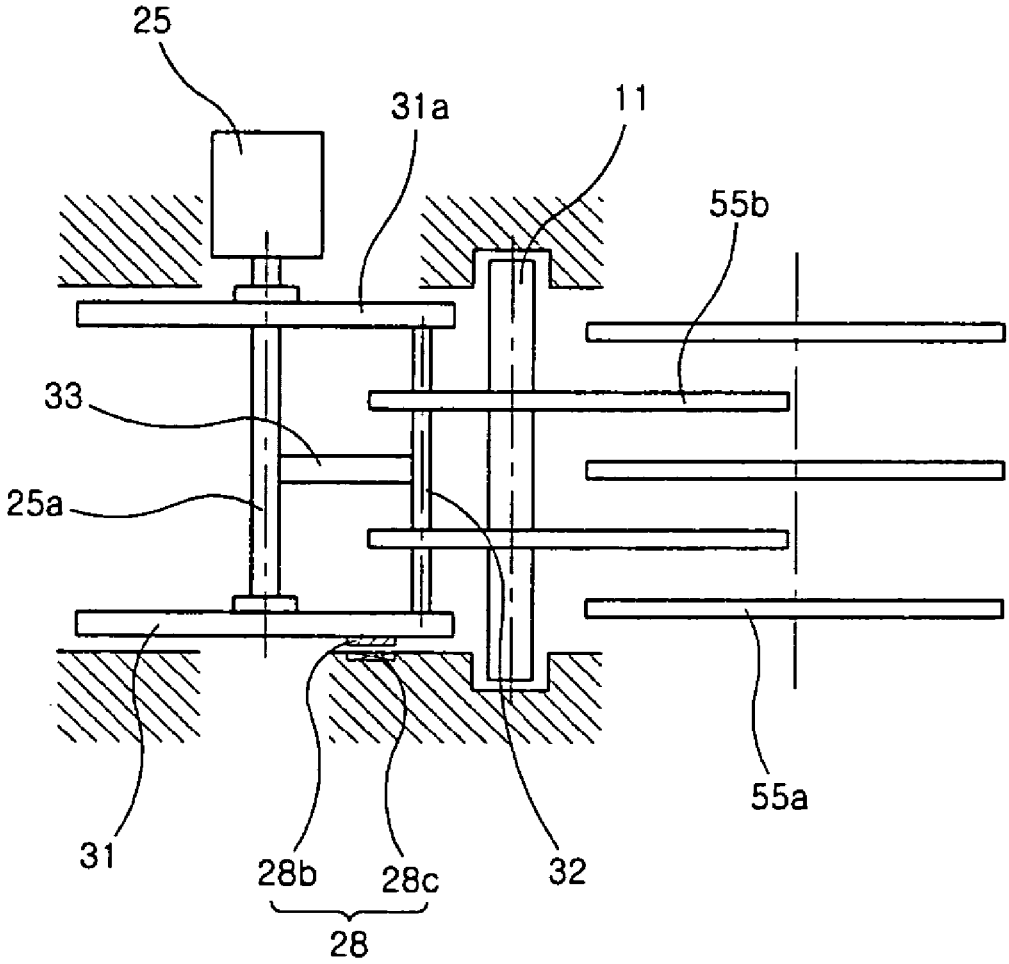
FIGS. 13*a* and 13*b* are a plan view and a front view respectively showing an ice-crushing device for refrigerators according to a fifth preferred embodiment of the present invention.
Figure 13B:
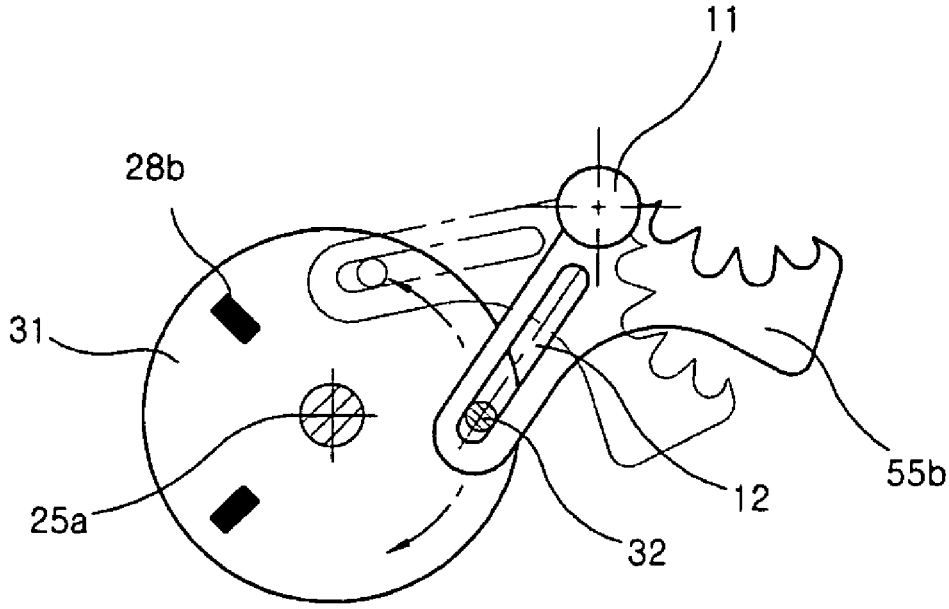

FIGS. 13*a* and 13*b* are a plan view and a front view respectively showing an ice-crushing device for refrigerators according to a fifth preferred embodiment of the present invention.

As shown in FIGS. 13*a* and 13*b*, the driving unit 20 of the ice-crushing device for refrigerators according to the fifth preferred embodiment of the present invention comprises rotary driving disks 31 and 31*a*, which are rotated by the driving force of the motor 25. The rotary driving disks 31 and 31*a* are a pair of rotary driving disks 31 arranged such that one of the rotary driving disks is disposed in front of the other rotary driving disk while the rotary driving disks are spaced apart from each other. A motor shaft 25*a* is integrally inserted through the center parts of the rotary driving disks 31 and 31*a*.

Between the rotary driving disks 31 and 31*a* is disposed an actuating pin 32, which is integrally fixed to a predetermined position of the rotary driving disk 31 and to the corresponding position of the rotary driving disk 31*a* through the guide slits 12 of the stationary blades 55*b*. The actuating pin 32 is connected to the motor shaft 25*a* via a reinforcing bar 33. The rotation of the rotary driving disks 31 and 31*a* and the actuating pin 32 is restricted by a position detecting unit 28.

As in the second and third preferred embodiments of the present invention, the position detecting unit 28 according to the fifth preferred embodiment of the present invention comprises: a plurality of position detecting pieces 28*b* formed at one side surface of the rotary driving disk 31; and a detecting sensor 28*c* disposed opposite to the position detecting pieces 28*b*. When the rotary driving disk 31 is rotated by the motor 25, the position detecting pieces 28*b* of the rotary driving disk 31 are detected by the detecting sensor 28*c*. When the position detecting pieces 28*b* of the rotary driving disk 31 are detected by the detecting sensor 28*c*, the motor 25 is rotated in alternating directions. In this way, the rotation of the rotary driving disks 31 and 31*a* and the actuating pin 32 is restricted.

When the rotary driving disks 31 and 31*a* are rotated counterclockwise by the driving force of the motor 25 as shown in FIG. 13*b*, the actuating pin 32 disposed between the rotary driving disks 31 and 31*a* is moved along the guide slits 12 of the respective stationary blades 55*b*, and therefore, the stationary blades 55*b* are rotated clockwise about the rotary shaft 11.

When the rotary driving disks 31 and 31*a* are rotated clockwise by the driving force of the motor 25, on the other hand, the actuating pin 32 disposed between the rotary driving disks 31 and 31*a* is moved along the guide slits 12 of the respective stationary blades 55*b*, and therefore, the stationary blades 55*b* are rotated counter clockwise about the rotary shaft 11. When the rotary driving disks 31 and 31*a* are rotated clockwise by the driving force of the motor 25, the position detecting pieces 28*b* of the rotary driving disk 31 are detected by the detecting sensor 28*c*. When the position detecting pieces 28*b* of the rotary driving disk 31 are detected by the detecting sensor 28*c*, the motor 25 is rotated in alternating directions. In this way, the rotation of the rotary driving disks 31 and 31*a* and the actuating pin 32 is restricted.

As apparent from the above description, the ice-crushing device for refrigerators does not comprise the damper operated as the ice mode is switched between crushed ice mode and ice cube mode. According to the present invention, the stationary blades have a damper function. Consequently, the present invention has the effect of preventing stoppage of crushed ice, which is conventionally caused by the provision of the damper, and therefore, eliminating a locking phenomenon, which is conventionally caused by the stoppage of crushed ice. Furthermore, the present invention has the effect of increasing operating accuracy of the ice-crushing device for refrigerators, and therefore, improving performance and reliability of the ice-crushing device for refrigerators.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An ice-crushing device for refrigerators, comprising:

a first set of blades rotatable about a first rotary shaft by a driving force, each blade of the first set of blades comprising a guide slit formed in a side thereof;

a second set of blades fitted on a second rotary shaft of a motor for performing a rotating operation; and an actuating lever having a first end extending in the guide slits, the actuating lever being rotated about a second end of the actuating lever when a driving force of a driving unit is transmitted to the actuating lever, to perform a rectilinear reciprocating movement along the guide slits, wherein the second set of blades applies a torque to the first set of blades when the ice-crushing device performs an ice-crushing operation, and an angle between a first reference line, which is a line passing through a center of the actuating lever, and a second reference line, which is a line passing from the first end of the actuating lever through the center of the first rotary shaft, is an acute angle.

2. The device as set forth in claim 1, further comprising:

first and second stoppers disposed above and under the actuating lever for restricting rotation of the actuating lever, respectively.

3. The device as set forth in claim 2, wherein the first and second stoppers have shock-absorbing members disposed on outer circumferential surfaces of the first and second stoppers.

4. The device as set forth in claim 1, wherein the driving unit comprises:

a driving lever integrally formed with an end of a central rotating shaft, which longitudinally extends along the rotation center of the actuating lever, the driving lever being formed in the shape of a crank such that the driving lever is symmetrical to the actuating lever about the middle of the central rotating shaft; and a solenoid linked with the driving lever, the solenoid having a rod, which is vertically reciprocated, when the solenoid is turned on/off, to rotate the driving lever about the central rotating shaft.

5. The device as set forth in claim 4, wherein the solenoid is provided at the lower end of the rod thereof with a hook, which is opened at the front and rear parts thereof and has an actuating space part, the driving lever being inserted through the actuating space part of the hook.

6. The device as set forth in claim 4, wherein the actuating lever has a restoring spring mounted thereon for returning the actuating lever to its original position when the solenoid is turned off.

7. The device as set forth in claim 1, wherein the driving unit comprises a central rotating shaft longitudinally extending along a rotation center of the actuating lever, the central rotating shaft receiving the driving force from a motor through a spur gear set for performing a rotating operation.

8. The device as set forth in claim 7, further comprising:

a position detecting unit for restricting the rotation of the central rotating shaft, the position detecting unit including:

a rotary disk fitted on the central rotating shaft;

a plurality of position detecting pieces formed at the rotary disk; and a detecting sensor disposed opposite to the position detecting pieces for detecting the rotation of the central rotating shaft.

9. The device as set forth in claim 1, wherein the driving unit comprises a central rotating shaft longitudinally extending along a rotation center of the actuating lever, the central rotating shaft receiving the driving force from a motor through a bevel gear set for performing a rotating operation.

10. The device as set forth in claim 9, further comprising:

a position detecting unit for restricting the rotation of the central rotating shaft, the position detecting unit including:

a rotary disk fitted on the central rotating shaft;

a plurality of position detecting pieces formed at one side surface of the rotary disk; and a detecting sensor disposed opposite to the position detecting pieces for detecting the rotation of the central rotating shaft.

11. The device as set forth in claim 1, wherein the driving unit comprises a central rotating shaft longitudinally extending along a rotation center of the actuating lever, the central rotating shaft receiving the driving force from a solenoid through a rack and pinion for performing a rotating operation.

12. The device as set forth in claim 11, wherein the actuating lever has a restoring spring mounted thereon for returning the actuating lever to its original position when the solenoid is turned off.

13. The device as set forth in claim 1, wherein the driving unit comprises:

rotary driving disks rotatable in alternating directions by a driving force of a motor; and an actuating pin inserted through the guide slits of the stationary blades for performing a rectilinear reciprocating movement along the guide slits as the rotary driving disks are rotated.

14. The device as set forth in claim 13, wherein the rotary driving disks are a pair of rotary driving disks arranged such that one of the rotary driving disks is disposed in front of the other rotary driving disk while the rotary driving disks are spaced apart from each other, and the actuating pin is inserted through the guide slits of the first blades between the rotary driving disks.

15. The device as set forth in claim 14, wherein the rotary driving disks are fitted on a motor shaft, which is inserted through centers of the rotary driving disks, such that one of the rotary driving disks is disposed in front of the other rotary driving disk while the rotary driving disks are spaced apart from each other, and the actuating pin is connected to the motor shaft via a reinforcing bar.

16. The device as set forth in claim 13, further comprising:

a position detecting unit for restricting the rotation of the central rotating shaft.

17. The device as set forth in claim 16, wherein the position detecting unit comprises:

a plurality of position detecting pieces formed at a rotary disk; and a detecting sensor disposed opposite to the position detecting pieces for detecting the position of the actuating pin.

* * * * *